United States Patent [19]

Baumann

[11] 4,227,552

[45] Oct. 14, 1980

[54] WEAVING MACHINE HAVING AN AIR DUCT FOR CLEANING PURPOSES

[75] Inventor: Heinz Baumann, Winterthur, Switzerland

[73] Assignee: Sulzer Brothers Limited, Winterthur, Switzerland

[21] Appl. No.: 959,514

[22] Filed: Nov. 13, 1978

[30] Foreign Application Priority Data

Nov. 17, 1977 [CH] Switzerland ..... 014037/77

[51] Int. Cl.[2] ..... D03D 49/00

[52] U.S. Cl. ..... 139/1 C

[58] Field of Search ..... 139/1 R, 1 C; 19/205; 28/172, 173; 181/198

[56] References Cited

U.S. PATENT DOCUMENTS

| | | | |
|---|---|---|---|
| 3,378,998 | 4/1968 | Shackelford | 139/1 C |
| 3,451,435 | 6/1969 | Riha et al. | 139/1 C |
| 3,627,201 | 12/1971 | Partsch | 139/1 C |
| 3,921,675 | 11/1975 | Filter et al. | 139/1 C |

*Primary Examiner*—Henry Jaudon

*Attorney, Agent, or Firm*—Kenyon & Kenyon

[57] ABSTRACT

Removable bearer members in the form of rails are removably mounted on studs at the picking and catching side. The bearer members allow the air duct to be moved horizontally out of the vertical plane of the shafts of the shedding mechanism so as to permit removal of the shafts during a warp beam change.

11 Claims, 5 Drawing Figures

Fig. 3
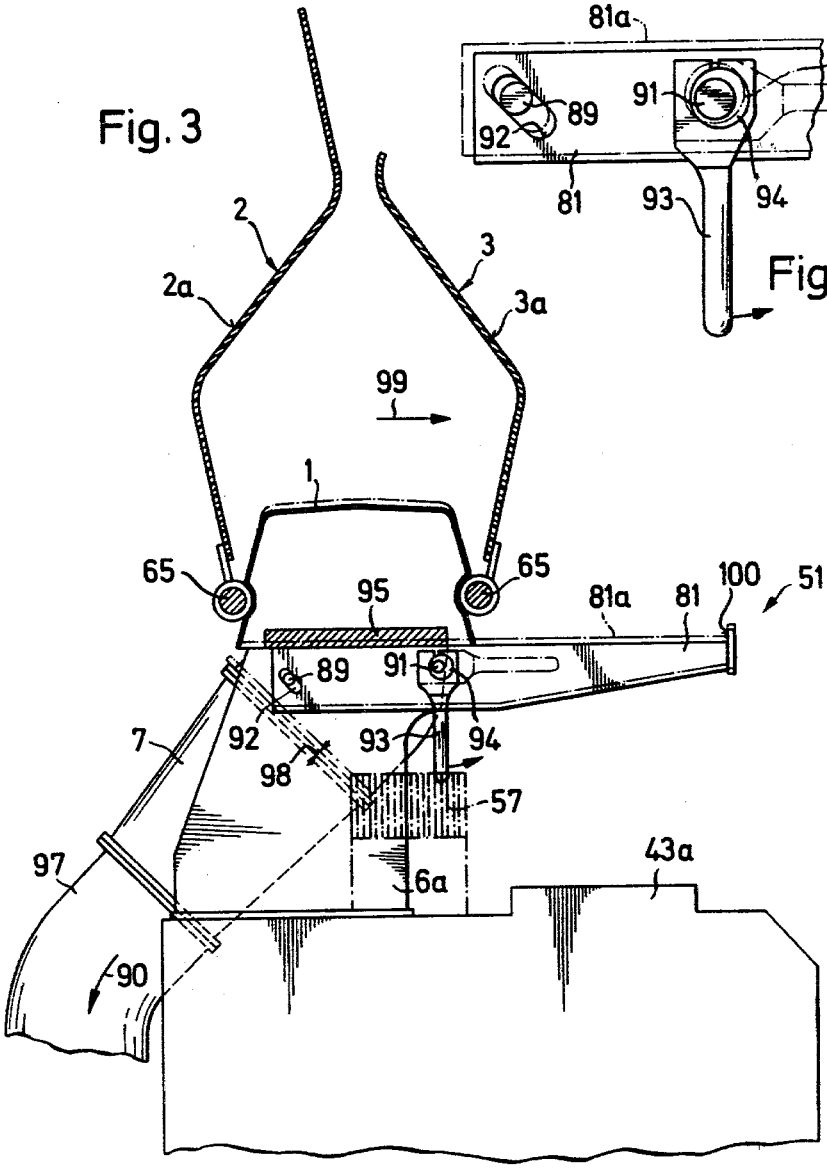
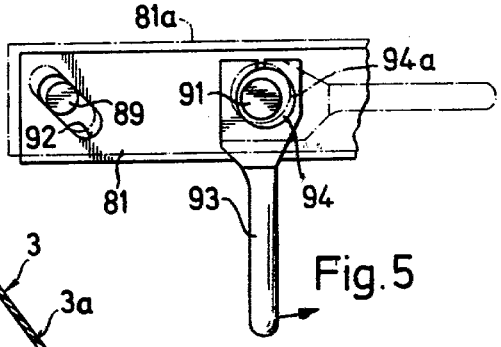
Fig. 5

WEAVING MACHINE HAVING AN AIR DUCT FOR CLEANING PURPOSES

This invention relates to a weaving machine. More particularly, this invention relates to a weaving machine having an air duct for cleaning purposes.

As is known, it is becoming common practice to provide covers for weaving machines not only to reduce the amount of lint, dust or the like which may be given off during a weaving operation but also to attenuate noise. In some cases, weaving machines have been provided with air ducts and covers so that foreign particles, such as dust and lint, may be drawn off through the duct for disposal outside of the environment of the weaving machine. In one case, for example as described in Swiss Patent Application No. 13,503/77, an air duct is disposed above the weaving plane of a weaving machine in a fixed or stationary manner together with a cover. However, this construction can interfere with any change-over operation which becomes necessary in the shafts of the weaving machine, since the air duct must be removed together with the cover when the shafts are inserted or when a shaft change is made, for example when a new warp beam is fitted in place. This presents a complicated procedure and is cumbersome to carry out.

Accordingly, it is an object of the invention to provide a weaving machine with a cleaning duct which provides minimum interference with a warp beam change.

It is another object of the invention to provide a simple means of moving an air duct within a weaving machine to permit access to other parts.

It is another object of the invention to reduce the time required for making a change in the shafts of a covered weaving machine.

Briefly, the invention is directed to a weaving machine having a frame with a picking side and a catching side, a means for moving a weft through a predetermined weft path in a weaving plane from a picking side to the catching side, an air duct which extends parallel to the weft path above the weaving plane and at least one flap which is secured to the duct to cover at least a part of the weaving plane. In accordance with the invention, a pair of removable bearer members are mounted on the frame at the respective picking side and catching side in order to permit movement of the air duct thereon.

The removable bearer members are initially mounted on the machine frame so as to be disposed below the air duct. In addition, each member which may be in the form of a rail is pivotally mounted on a stud on the weaving machine frame at each of the picking side and catching side. In addition, each rail has an elongated slot which receives a second stud on the machine frame. When put in place, the rails extend unilaterally towards a cloth beam end of the weaving machine. Each rail is also provided with an eccentric which is disposed about the pivot stud so that upon rotation of the eccentric, the rail can be moved vertically. The elongated slot of the rail is orientated such that the rail is retained in a horizontal position during vertical adjustment.

Should it become necessary to move the air duct, the flap is lifted and bearer member is mounted on each pair of studs at the picking and catching sides. Thereafter, the eccentric on each bearer member is rotated to cause the bearer member to lift vertically while being maintained in a horizontal position. This causes a slight lifting of the air duct from the machine frame. When raised, the air duct can be moved along the bearer members to a position which does not hinder access to a shedding mechanism in the weaving machine or a shaft change. After a shaft change has been made, the air duct can be moved back into place and the bearer members lowered to place the air duct back in position.

In accordance with the invention, one pair of bearer members can be used for a relatively large number of weaving machines, and possibly for all the machines of a mill in question. There is no need to provide each member with a special device for moving the air duct and flaps when the shafts are changed. In addition, since the bearer members intended for the displacement of the air duct are removed during weaving, these members do not project from the machine during normal operation and, therefore, do not form a source of danger to the operators.

In addition, since the bearer members are removed during weaving, they do not form an obstacle to the cover flaps on the air duct when the flaps are in the lowered (operative) position. The shape of the cover flaps can advantageously be substantially adapted to the shape of the weaving machine above the weaving plane. Starting from the point where the flaps are fixed on the air duct, the flaps can initially extend steeply downwards substantially along the shedding mechanism, e.g. the shafts, and then, after a bend or curve, extend in a substantially flat configuration along the weaving plane as far as the tensioning and cloth take-up beams. The volume of space between the flaps and the top parts of the weaving machine (the shafts and the weaving plane) is thus relatively small so that a particularly effective air current can be maintained therein.

These and other objects and advantages of the invention will become more apparent from the following detailed description and appended claims taken in conjunction with the accompanying drawing in which:

FIG. 1 diagrammatically illustrates a weaving machine according to the invention as viewed from the cloth side;

FIG. 3 illustrates a view similar to FIG. 2 with a bearer member in place below an air duct on the weaving machine;

FIG. 5 illustrates a means for effecting a vertical adjustment of a bearer member in accordance with the invention.

Figure 1:
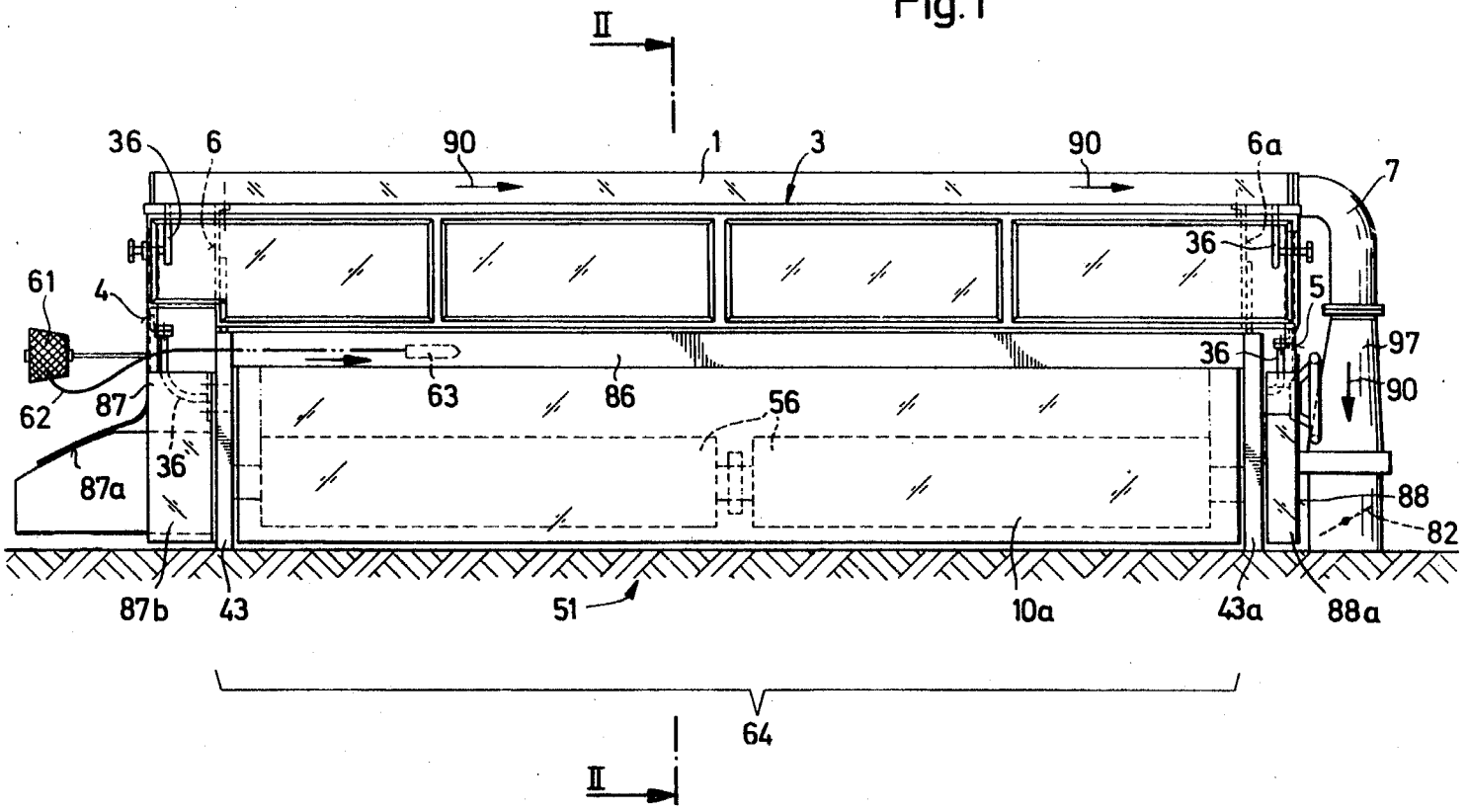
Figure 2:
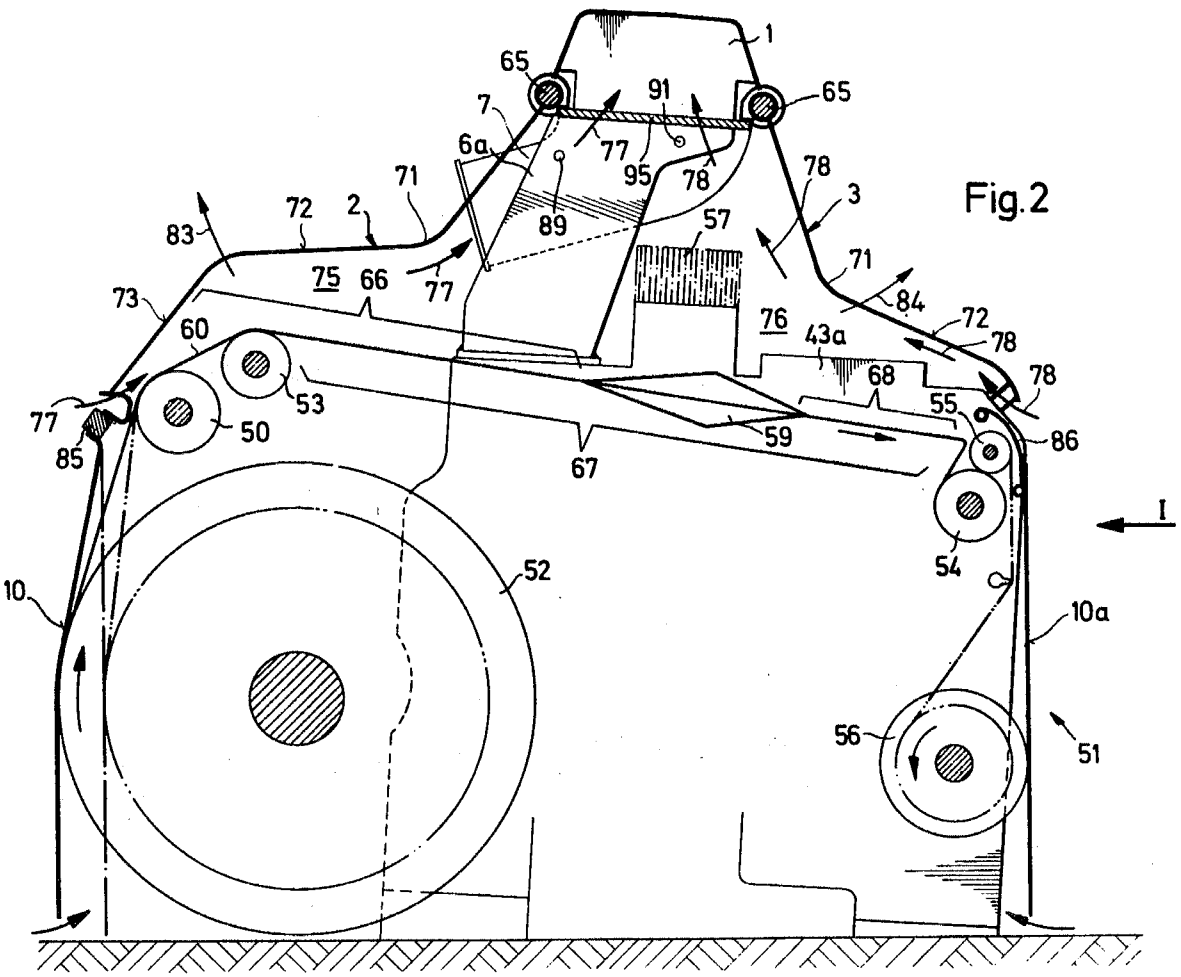
FIG. 2 illustrates a view taken on line II—II of FIG. 1 to an enlarged scale.

Referring to FIG. 1, the weaving machine 51 has a frame of generally conventional structure including two side members 43, **43*a* which are associated at a picking side and a catching side, respectively. In addition, as shown in FIG. 2, the weaving machine 51 has a warp beam end at which a warp beam 52, a deflector beam 50 and a tensioning beam 53 are located as well as a cloth beam end at which a cloth take-up beam 54, a presser roller 55, and a cloth beam 56 are located. Also, a shedding mechanism, for example composed of shafts 57 is provided between the warp beam end and cloth beam end in order to form a shed 59 of warp yarns which are delivered from the warp beam 52. As shown in FIG. 1, a weft yarn supply bobbin 61 is located near the picking side of the machine in order to introduce a weft yarn 62** into the shed, for example by means of a gripper projectile 63. As indicated, the weft yarn 62 is movable through a weft path in a weaving plane 67 from the picking side to the catching side of the machine. As shown in FIG. 2, the weaving plane 67 extends from the tensioning beam 53 to the take-up beam 54 while a warp zone 66 of the weaving plane extends from the deflector beam 50 to the shed 59 and a cloth zone 68 extends from the shed 59 to the take-up beam 54.

Referring to FIGS. 1 and 2, an air duct 1 extends parallel to the weft path above the weaving plane 67 and substantially above the shafts 57 over the entire width 64 of the weaving machine. This duct 1 serves to discharge fly dust, lubricant mist, and the like. As shown, the duct 1 is mounted on two members 6, 6*a* which are, in turn, fixed on the side members 43, 43*a* of the weaving machine.

In addition, a pair of cover flaps 2, 3 are hinged on the air duct 1 by means of hinges 65. Each flap 2, 3 extends from the duct 1 to cover at least a part of the weaving plane 67. As indicated, one flap 2 extends over the warp zone 66 while the other flap 3 substantially covers the cloth zone 68. Each flap 2, 3 first extends from the hinges 65 in a steep downward direction substantially along the shafts 57 and then bends through a curve 71 into a zone 72 in which the flaps 2, 3 flatten out substantially along the zones 66, 68 of the weaving plane 67. At the free end 73, the flap 2 is directed downwardly at a steep angle so that a relatively large zone 60 of the warp yarns is covered between the deflector beam 50 and the tensioning beam 53.

Each of the cover flaps 2, 3 thus form chambers 75, 76 with the weaving machine. Further, the shape of each cover flap 2, 3 is adapted to the shafts 57 and the adjoining zone 66, 68 so that the volume of the chambers 75, 76 is relatively small. Thus, the outgoing air flow in the direction indicated by the arrows 77, 78 has a relatively high speed. Consequently, a relatively intense suction action can be obtained in the zones beneath the duct 1 and the flaps 2, 3. Fly dust is thus extracted in a very effective manner and passes into the air duct 1 through openings therein. As indicated in FIG. 1, the air entrained foreign matter exhausts via a bend 7 and an extraction line 97 as indicated by an arrow 90 past a control flap 82, a fan (not shown) and filters, if required, to the atmosphere or other exhaust point.

As shown in FIG. 1, each side of the machine 51 may be provided with two cover plates 4, 5 which are fixed on members 36. In addition, a curtain 10 consisting, for example of a plastic sheeting, is provided at the warp end on a rod 85 while the corresponding curtain 10*a* is provided at the cloth end on a breast plate 86 of the weaving machine 51. A curtain 87 with flaps 87*a*, 87*b* is provided on the picking side and a curtain 88 with flaps 88*a* is provided on the catching side (FIG. 1). These curtains 10, 10*a*, 87, 88 together with the flaps 2, 3 serve to attenuate the noise emitted by the weaving machine.

In order to move the air duct 1 out of the way to effect a change in the shafts 57, a pair of bearer members 81 (FIG. 3) are provided. In addition, a pair of studs 89, 91 are secured on each of the members 6, 6*a* (FIG. 2) to receive a respective bearer member 81. As shown in FIG. 3, each bearer member 81 is in the form of a rail of elongated shape having a flat surface parallel to the longitudinal axis of the rail and a stop 100 at the end of the surface. Each rail 81 also has an inclined elongated slot 92 for receiving one stud 89 while an eccentric 94 is rotatably mounted in the rail 81 to receive the other stud 91 on the machine 51. A lever 93 is also secured to and extends from the eccentric 94 for rotating the eccentric 94 in the rail 81. As indicated, the slot 92 is disposed at an acute angle to the horizontal surface of the rail 81 and is spaced longitudinally from the eccentric 94.

When the shafts 57 are to be removed, for example on a change of the warp beam 52, the flaps 2, 3 are swung up in the direction indicated by the arrows 83, 84 into the position 2*a*, 3*a* as shown in FIG. 3. Next, a rail 81 is fitted onto the studs 89, 91 of each of the members 6, 6*a* on the picking and catching sides. In this position, each rail 81 extends in a rest position unilaterally towards the cloth side in a horizontal plane.

Figure 4:
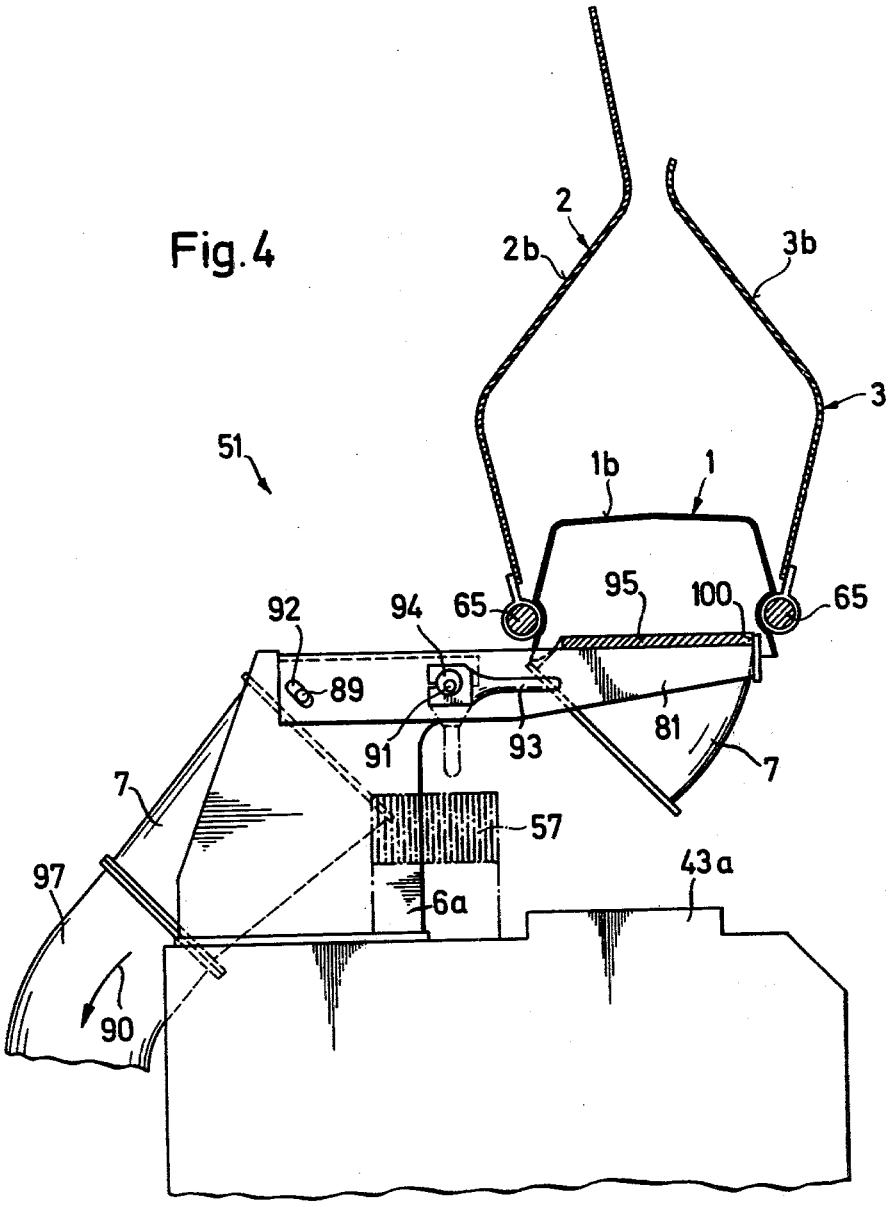
FIG. 4 illustrates a view similar to FIG. 3 with the air duct displaced on a bearer member in accordance with the invention.

After the rails 81 have been fitted into the rest position, the lever 93 is turned 90° to the dotted line position as shown in FIGS. 3 and 5 in order to rotate the eccentric 94 on the stud 91. The lever 93 and eccentric 94 thus take up the position as shown in FIG. 4. At the same time, the rail 81 is lifted into the broken line position 81*a* (FIGS. 3 and 5) and is moved somewhat to the left as viewed in FIG. 3 as a result of the action of the eccentric 94 and the slot 92. At the same time, the rail 81 retains a horizontal position. In this active position, as shown in FIG. 4, each rail 81 engages beneath a bearer plate 95 fixed on the air duct 1 and lifts the air duct 1 together with the flaps 2, 3. A clearance 98 thus forms between the bend 7 and the extraction line 97 (the bend 7 being fixedly connected with the duct 1). The duct 1 and flaps 2, 3 are then readily moved to one side in the direction indicated by the arrow 99 (FIG. 3), i.e. to the right as viewed, as far as a stop 100 on the end of the rail 81. The duct 1 and flaps 2, 3 thus take up the positions 1*b*, 2*b*, 3*b* as shown in FIG. 4. In this position, the air duct and flaps 2, 3 are no longer above the shafts 57 so that the shafts 57 can be moved upwardly.

It is to be noted that feed rollers or roller chains can be disposed on the rails 81 in order to move the duct 1 and the flaps 2, 3 thereon.

Further, conditioned air can be supplied via the air duct 1 and, if required, can be discharged through a bottom duct disposed, for example between the warp beam 52 and the cloth beam 56.

If required, a cover flap may be provided on only one side of the air duct 1, for example on the warp side. The air duct 1 may also be made of a two part construction, that is of two adjacent pipes.

What is claimed is:

1. In combination with a weaving machine having a frame having a picking side and a catching side and means for moving a weft yarn through a predetermined weft path in a weaving plane from said picking side to said catching side;

an air duct extending parallel to said path above said weaving plane, a shedding mechanism below said air duct between a warp beam end and a cloth beam end of said machine, at least one flap secured to said duct to cover at least a part of said weaving plane, and removable bearer members mounted on said frame below said air duct, each said member being disposed at a respective one of said picking side and said catching side to move said air duct.

2. The combination as set forth in claim 1 wherein said weaving machine further includes a pair of said flaps, each said flap being disposed on an opposite side of said duct from the other of said flaps to cover over at least a part of said weaving plane at a respective warp beam end and cloth beam end, and wherein said bearer members extend unilaterally towards said cloth beam end.

3. The combination as set forth in claim 1 wherein said frame has a pair of studs at each of said picking side and said catching side and each bearer members is a rail pivotally mounted on one of said studs on a respective side, said rail having an elongated slot receiving the other of said studs therein.

4. The combination as set forth in claim 3 wherein each rail has an eccentric therein disposed about said one stud for vertical adjustment of said rail.

5. The combination as set forth in claim 4 wherein said elongated slot is oriented to retain said rail in a horizontal position during vertical adjustment thereof.

6. In combination with a weaving machine having a frame with a picking side, a catching side, a warp beam end, a cloth beam end, and means for moving a weft yearn through a weft path in a weaving plane from said picking side to said catching side;

an air duct extending parallel to said path above said weaving plane for carrying off air entrained impurities from said machine;

at least one flap hinged to and extending from said duct to cover at least a part of said weaving plane at one of said ends; and bearer members removably mounted on said frame, each said member being disposed at a respective one of said picking side and said catching side to movably receive said air duct thereon.

7. The combination as set forth in claim 6 wherein each bearer member is movable between a rest position, below and spaced from said duct and an active position having said duct supported thereon.

8. The combination as set forth in claim 7 which further includes means for moving each bearer member between said positions, said means including a first stud mounted on said frame, an eccentric removably mounted on said stud and within said member, a second stud mounted on said frame and slidably received in an elongated slot in said member and an arm fixed to said eccentric for rotating said eccentric on said first stud to raise and lower said member while said member is retained horizontally.

9. The combination as set forth in claim 8 wherein said member is a rail.

10. A bearer member for mounting on a weaving machine to vertically raise and lower an air duct thereon, said member having a flat surface parallel to a longitudinal axis thereof, an eccentric rotatably mounted in said rail, and an elongated slot spaced longitudinally from said eccentric and disposed at an acute angle to said surface.

11. A bearer member as set forth in claim 10 having a lever secured to and extending from said eccentric for rotating said eccentric in said member.

* * * * *